US006877183B2

(12) United States Patent
Rosa et al.

(10) Patent No.: US 6,877,183 B2
(45) Date of Patent: Apr. 12, 2005

(54) STEAM CLEANING APPLIANCE

(75) Inventors: Carlo Rosa, Prato (IT); Paolo Fanciullacci, Empoli (IT)

(73) Assignee: Ariete S.p.A. (IT)

( * ) Notice: Subject to any disclaimer, the term of this patent is extended or adjusted under 35 U.S.C. 154(b) by 436 days.

(21) Appl. No.: 10/222,897

(22) Filed: Aug. 19, 2002

(65) Prior Publication Data

US 2003/0056316 A1 Mar. 27, 2003

(30) Foreign Application Priority Data

Sep. 26, 2001 (IT) ..... GE2001A0074

(51) Int. Cl.[7] ..... F17C 7/04; A47L 5/00; A47L 5/14

(52) U.S. Cl. ..... 15/320; 15/321; 15/344; 392/394; 392/403

(58) Field of Search ..... 15/320, 321, 344; 392/394, 403, 404

(56) References Cited

U.S. PATENT DOCUMENTS 3,272,258 A * 9/1966 Bourquard ..... 165/259
4,457,042 A * 7/1984 Jones et al. ..... 15/322
5,063,634 A * 11/1991 Hafele et al. ..... 15/377
5,121,464 A * 6/1992 Hanada et al. ..... 392/405
6,640,383 B2 * 11/2003 Tsen ..... 15/321
6,675,437 B1 * 1/2004 York ..... 15/321
2002/0116784 A1 * 8/2002 Sumner ..... 15/322
2002/0144374 A1 * 10/2002 Tsen ..... 15/321

FOREIGN PATENT DOCUMENTS

EP 0 719 516 * 7/1996

* cited by examiner

*Primary Examiner*—Terrence R. Till
(74) *Attorney, Agent, or Firm*—Stites & Harbison PLLC; Marvin Petry

(57) ABSTRACT

Steam cleaning appliance comprising a carter housing a steam-generating device, and supply means for the steam thus generated, said means comprising: a supply mouth of the steam-generating device communicating with a supply nozzle, which can be coupled with steam supply tools, said mouth and said nozzle being connected by means of a first and a second pipe. The first pipe being provided with first shut off means for the steam flow arranged directly downstream from said mouth, and further equipped with control means which can be operated manually, and the second pipe being provided with second shut off means for the steam flow arranged directly upstream from said nozzle. Opening means are provided for said second shut off means, which can be operated by coupling said nozzle with a given steam supply tool, said tool being provided with steam supply control means.

6 Claims, 3 Drawing Sheets

STEAM CLEANING APPLIANCE

BACKGROUND AND SUMMARY OF THE INVENTION

The present invention relates to steam cleaning appliances and in particular to portable steam cleaning appliances.

There are several types of steam cleaning appliances whose features differ according to the kind of cleaning operation they have to perform, both as far as the object to be cleaned is concerned, i.e. a wall rather than a work top, or a floor or window glasses, and as far as sizes are concerned, i.e. from small domestic needs to industrial cleaning.

In general, most of these devices have a carter housing the steam-generating device, and steam supply means connected to said device; it is anyway important to be able to control the jet of steam in the most suitable way according to the needs. Normally, the so-called portable steam cleaning appliances, i.e. mainly suited for domestic use, are provided with a supply control, generally a pushbutton placed on the device body, so as to enable their use with only one hand. Many of these devices, however, are equipped with extensions of the steam supply pipe; this gives the device a greater versatility, but forces the user to use one hand to grasp the extension and the other hand to control the supply pushbutton.

The present invention aims to provide a steam cleaning appliance allowing the user to control the direction of the jet of steam and the steam supply pushbutton using only one hand, also when using extensions of the steam supply pipe.

The object of the present invention, therefore, is a steam cleaning appliance comprising a carter housing a steam-generating device, and supply means for the steam thus generated, said means comprising: a supply mouth of the steam-generating device communicating with a supply nozzle, which can be coupled with steam supply tools, said mouth and said nozzle being connected by means of two pipes, of which a first pipe being provided with shut off means for the steam flow arranged directly downstream from said mouth, and equipped with control means which can be operated manually, and a second pipe being provided with shut off means for the steam flow arranged directly upstream from said nozzle, opening means being provided for said shut off means, which can be operated by coupling said nozzle with a given steam supply tool, said tool being provided with steam supply control means.

BRIEF DESCRIPTION OF THE DRAWINGS

Further advantages and characteristics will be evident from the following description of an embodiment of the steam cleaning appliance according to the present invention, made by way of nonlimiting example with reference to the attached drawings, in which.

DESCRIPTION OF THE PREFERRED EMBODIMENTS OF THE INVENTION

Figure 1:
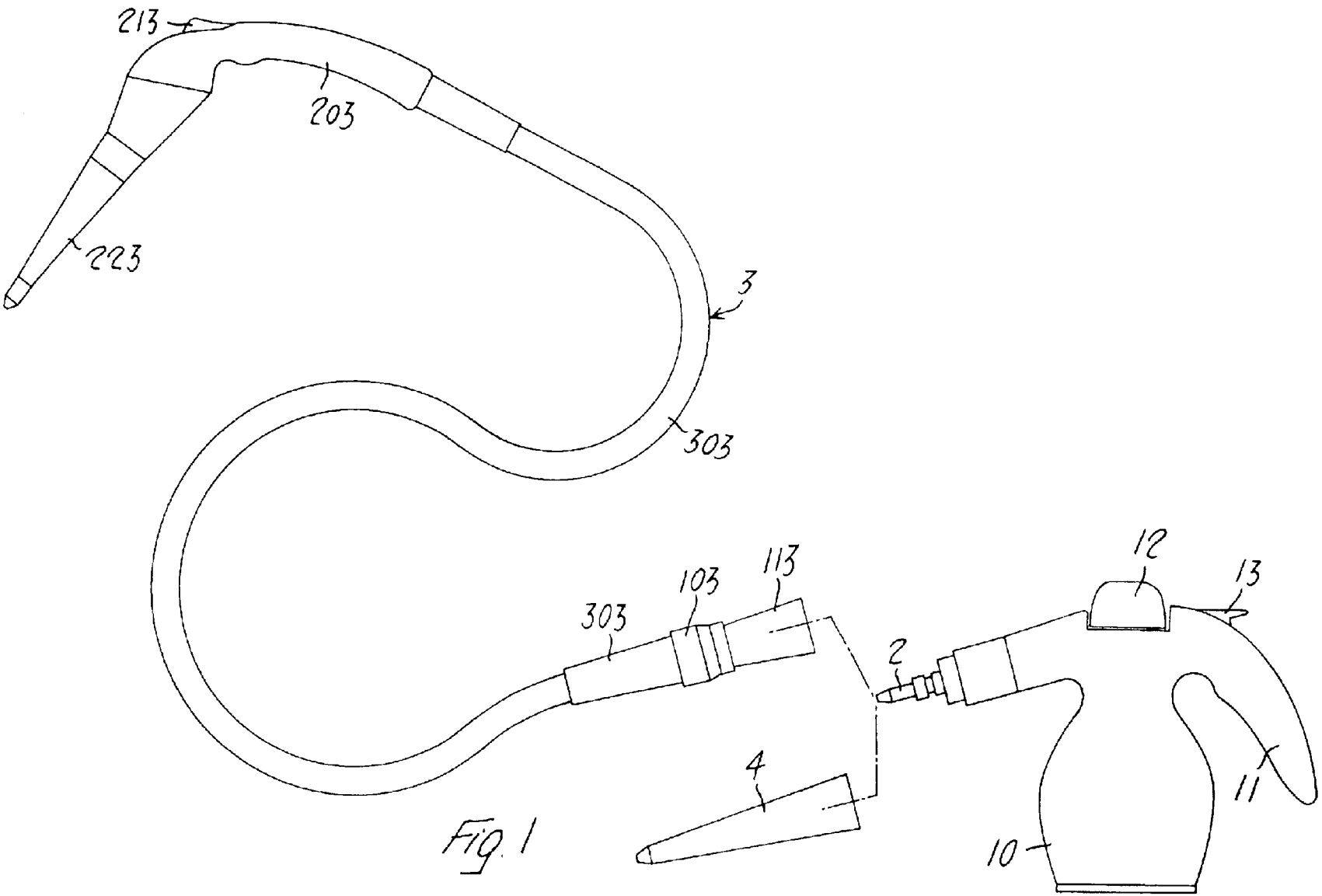
FIG. 1 is a side elevation view of the steam cleaning appliance according to the invention, with two different steam supply tools.

FIG. 1 shows the steam cleaning appliance according to the invention; the numeral 10 indicates the carter housing the steam-generating device, which is of a known type and which is not here further shown and described. Said carter 10 is provided with a handle 11, on whose top the pushbutton 13 is placed, which controls the steam supply as better described in the following; a plug 12 is further provided on the opening through which water is introduced into the steam-generating device. Steam gets out of the nozzle 2, which can alternatively be connected to a plurality of steam supply tools with different features according to the use they are meant for. Among others, are shown a nozzle 4 and the tool 3 comprising a connecting element 102 on which a tube 303 is mounted, said tube having on its opposite end a supply gun 203 provided with a pushbutton 213 for the control of steam supply and with a supply nozzle 223.

Figure 2:
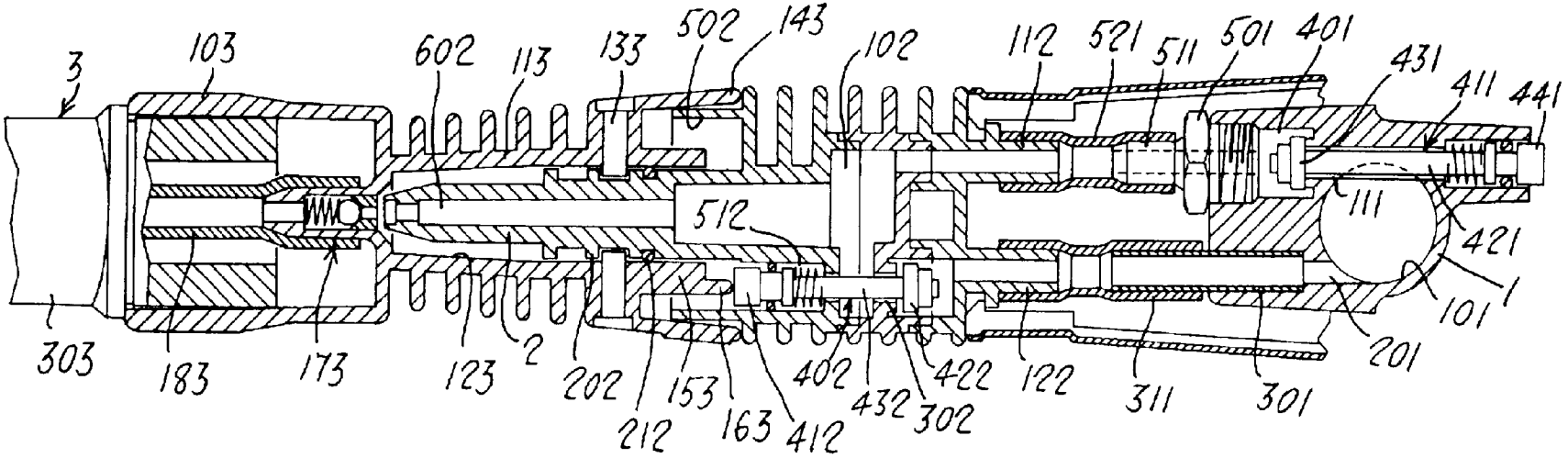
FIG. 2 is an enlarged sectional view showing the connection between the device according to the invention and one of the steam supply tools.

In FIG. 2 shows the connection between the nozzle 2 and the tool 3 is shown in section. From the steam discharge mouth 101 of the steam generator 1 it departs the pipe 201, formed within said generator, into which a tube 301 is fitted connected through the flexible pipe 311 to the hollow pin 122, which in turn communicates with the chamber 102 leading to the outlet channel 602 of the nozzle 2. Between said pin 122 and said chamber 102 a valve 402 is placed controlling with its head 422 a seat 302 and the stem 432 of which is conducted through the chamber 102 and ends with its other end 412 in a recess 512 of the ring-shaped cup 502 surrounding the nozzle 2. The chamber 102 further communicates through the hollow pin 112 and the flexible pipe 521 with the outlet 511 of the nipple 501, the latter being fitted into the seat 401. Within said seat operates the valve 411, the head 431 of which controlls the opening 111 formed in the body 1 of the steam generator; the stem 421 and its end 441 enable the operation of the head 431 with respect to the opening 111; the end 441 of the valve cooperates in a known and not further shown manner with the pushbutton 13 shown in FIG. 1.

The connecting element 103 of the tool 3 comprises a body 113 provided on its outlet end with an axial frustum conical flange 143, which cooperates with the peripheral rims of the cup 502 of the nozzle 2. The body 113 is further provided with an axial cavity 123 into which the nozzle 2 fits, said cavity ending on the end turned towards said nozzle 2 with an axially protruding cylindrical bushing 153. Retaining means 133 of the nozzle 2 operate through the body 113 and radially with respect to it, said means engaging with the radial expansions 202 of said nozzle; the sealing effect is ensured by the sealing element 212. The cam 163 axially protruding from the bushing 153 actuates the end 412 of the valve 402 so as to enable its opening, in order to enable the steam to enter into the chamber 102. A non-return valve 173 is arranged on the bottom of the cavity 123, directly upstream from the steam supply pipe 183.

Figure 3:
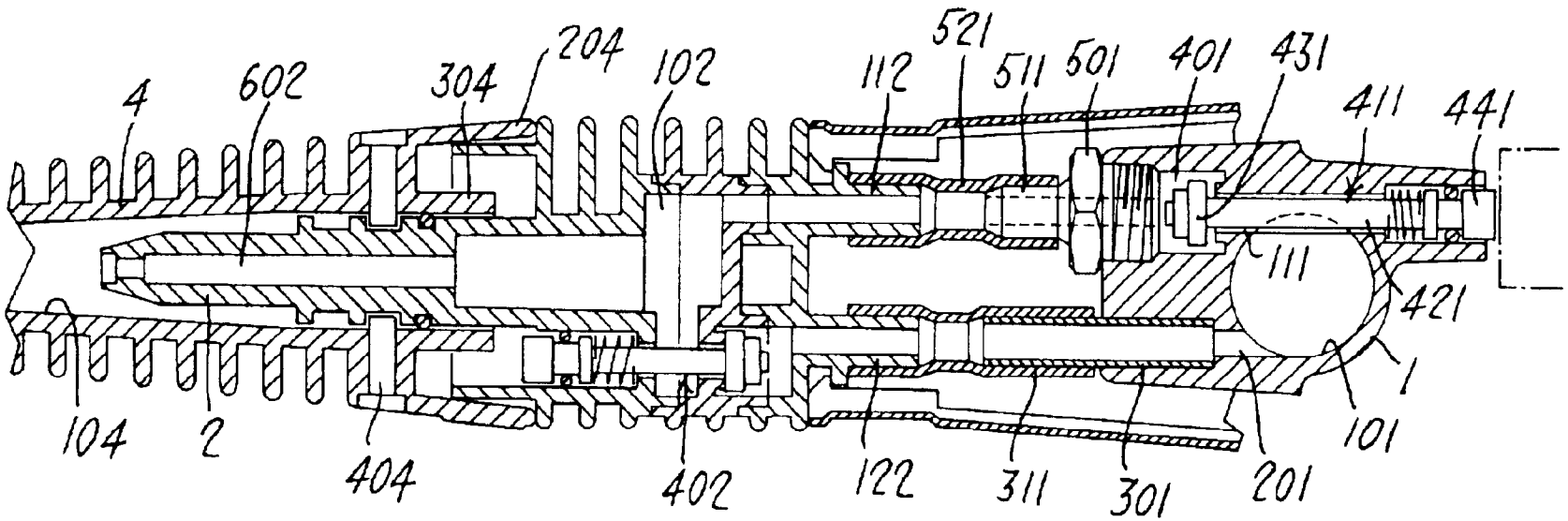
FIG. 3 is a view similar to FIG. 2, showing the connection with the other steam supply tool.

FIG. 3 is a sectional view of the connection between the nozzle 2 and the nozzle 4; the same parts are indicated with the same numerals. The nozzle 4 is provided with an inner axial cavity 104 housing the nozzle 2; the nozzle 4 is provided at its end turned towards said nozzle 2 with an axial peripheral frustum conical flange 204, whereas the said cavity ends on said end with the cylindrical bushing 304. The nozzle 4 is radially crossed by the blocking means 404 cooperating with the radial expansions 202 protruding from said nozzle in order to engage the latter in the connection with said nozzle 4. As can be seen from the figure, the valve 402 is closed and steam enters the chamber 102 of the nozzle 2 through the pipe 521 under the control of the valve 411, which can be operated manually by the user.

The operation of the steam cleaning appliance according to the present invention will be evident from the following description. The connection between the nozzle 2 and the suitable tool is, according to the specific case, the starting point for transferring the supply control for the steam produced in the steam generator 1. As can be seen from FIG. 2, the cam 163 protruding from the bushing 153 of the connecting element 103 of the tool 3 acts onto the end 412 of the valve 402 causing its opening and therefore allowing the steam flow to flow along the tube 303 of said tool 3 until reaching the supply gun 203. In this situation the emission of steam through the nozzle 223 will be controlled by a valve operated with the control pushbutton 213 placed on said supply gun 203; thus, though the tool 3 greatly extends the performance of the cleaning appliance according to the invention, its simple operation is effectively kept, allowing the user to use only one hand to control and direct the jet of steam generated. Vice versa, as is evident from FIG. 3, when a tool similar to the nozzle 4 is used, which therefore is coupled to the nozzle 2 without opening the valve 402 and keeping it open, the control of the steam supply has to be carried out by the valve 411 operated through the pushbutton 13.

In case that for any reason the pushbutton 13 is pushed when the nozzle is coupled with the tool 3, there will be no consequence; in fact the steam has already been introduced into the chamber 102 of the nozzle 2 and, through the latter, into the pipe 183 of the tube 303 of the tool 3, and its supply only depends on the operation of the pushbutton 213 of the supply gun 203.

Advantageously, in the connecting element 103 of the tool 3 a non-return valve 173 is provided for, directly downstream from the cavity 123 into which the nozzle 2 is introduced. Said valve avoids that, when the connection between the tool 3 and the nozzle 2 is removed, the steam which has gathered within the pipe 183 of the tube 303 gets out violently, thus representing a danger for the user.

The steam cleaning appliance thus conceived, therefore, on the one hand simplifies and makes safer the use of supply tools which can extend its performance, and on the other hand anyway keeps the same functional features for short distance applications.

What is claimed is:

1. Steam cleaning appliance comprising a carter housing a steam-generating device, and supply means for the steam thus generated, said means comprising:

a supply mouth of the steam-generating device communicating with a supply nozzle, which can be coupled with steam supply tools, said mouth and said nozzle being connected by means of a first and a second pipe, of which said first pipe is provided with first shut off means for the steam flow arranged directly downstream from said mouth, and provided with manually operable control means, and said second pipe is provided with second shut off means for the steam flow arranged directly upstream from said nozzle, opening means being provided for said second shut off means, which can be operated by coupling said nozzle with a given steam supply tool, said tool being provided with steam supply control means.

2. Steam cleaning appliance according to claim 1, in which said first shut off means for the steam flow of said first pipe arranged directly downstream from said mouth comprise a valve which can be operated on one end by means of a pushbutton placed on the carter of said device.

3. Steam cleaning appliance according to claim 1, in which said second shut off means for the steam flow of said second pipe arranged directly upstream from said nozzle comprise a valve which can be operated on one end through opening means which can be operated by coupling said nozzle with a given steam supply tool, said valve being placed with its axis parallel to the axis of said nozzle.

4. Steam cleaning appliance according to claim 1, in which said given steam supply tool comprises: a connecting element of said tool with said nozzle; a tubular element for steam transfer, and a supply element provided with steam supply control means.

5. Steam cleaning appliance according to claim 4, in which said connecting element comprises a body provided with an axial cavity housing said nozzle, the outlet end of said axial cavity being provided with a bushing axially protruding towards said nozzle, a cam axially protruding and cooperating with the end of said valve being provided on said bushing.

6. Steam cleaning appliance according to claim 5, in which in said connecting element a non-return valve is provided directly upstream from the tubular element for steam transfer.

* * * * *